US006671906B1

(12) United States Patent
Milligan

(10) Patent No.: US 6,671,906 B1
(45) Date of Patent: Jan. 6, 2004

(54) THERAPEUTIC SLEEP SYSTEM TO PROVIDE NEURO MUSCULO SKELETAL REEDUCATION OF THE CERVICAL SPINE

(76) Inventor: Patrick L. Milligan, 70-100 Mirage Cove Dr., #30, Rancho Mirage, CA (US) 92270

( * ) Notice: Subject to any disclaimer, the term of this patent is extended or adjusted under 35 U.S.C. 154(b) by 0 days.

(21) Appl. No.: 10/191,165

(22) Filed: Jul. 9, 2002

(51) Int. Cl.[7] ..... A47G 9/10
(52) U.S. Cl. ..... 5/636; 5/640; 5/645
(58) Field of Search ..... 5/636, 637, 639, 5/640, 643, 644, 645, 657, 723

(56) References Cited

U.S. PATENT DOCUMENTS

| | | | | |
|---|---|---|---|---|
| 3,243,828 A | * | 4/1966 | McCarthy | 5/636 |
| 4,320,543 A | | 3/1982 | Dixon | |
| 4,777,678 A | | 10/1988 | Moore | |
| 4,908,894 A | | 3/1990 | Sanders | |
| 5,163,195 A | * | 11/1992 | Hill | 5/637 |
| 5,168,590 A | * | 12/1992 | O'Sullivan | 5/490 |
| 5,360,017 A | | 11/1994 | Austin | |
| 5,363,524 A | | 11/1994 | Lang | |
| 5,644,810 A | * | 7/1997 | Kato | 5/645 |
| 5,727,267 A | | 3/1998 | Keilhauer | |
| 5,797,154 A | | 8/1998 | Contreras | |
| 5,809,594 A | * | 9/1998 | Isogai | 5/645 |
| 5,864,904 A | | 2/1999 | Rudick | |
| 5,953,777 A | * | 9/1999 | Buck | 5/636 |
| 6,003,177 A | | 12/1999 | Ferris | |
| 6,024,762 A | | 2/2000 | Gray | |
| 6,073,288 A | | 6/2000 | Berenstein | |
| 6,327,725 B1 | | 12/2001 | Veilleux et al. | |
| 6,349,437 B1 | | 2/2002 | Horning | |
| 6,363,557 B2 | * | 4/2002 | Chou | 5/645 |

FOREIGN PATENT DOCUMENTS

GB 2181949 A * 5/1987

* cited by examiner

*Primary Examiner*—Michael F. Trettel
(74) *Attorney, Agent, or Firm*—Stetina Brunda Garred & Brucker

(57) ABSTRACT

An adjustable pillow having an upper housing comprising a plurality of compartments, a plurality of support elements and a lower housing secured to the upper housing to keep the support elements inside the upper housing is disclosed. The support elements are configured to be positioned within one of the compartments. Each compartment has a height that is adjustable by varying the number of support elements positioned within the compartment. Preferably, the compartments include a neck support compartment, a head support compartment and a pair of side support compartments.

22 Claims, 6 Drawing Sheets

THERAPEUTIC SLEEP SYSTEM TO PROVIDE NEURO MUSCULO SKELETAL REEDUCATION OF THE CERVICAL SPINE

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to pillows and more particularly to a therapeutic sleep system that is adjustable to suit the needs of a given patient at a given time.

In the womb and for a period of time following the birth, a baby's spine is shaped like the letter C. This curve is known as a primary curve which is Kyphotic. As the baby gains muscular strength and ability secondary curves known as Lordotic curves develop in the cervical and lumbar regions. These curves continue to develop until growing stops. In a normal spine there are four types of spinal curvatures which are important to balance, flexibility and stress absorption and distribution. From the top (neck area) to the coccyx or tailbone, these curvatures are: cervical (Lordosis), thoratic (Kyphosis), lumbar (Lordosis) and sacral (Kyphosis).

Many people have incorrect curvatures which may cause pain and discomfort and/or compromise their balance, flexibility and ability to absorb and distribute stress. There are many methods of attempting to relieve pain and/or correct problems with curvatures of the spine. One such method is the use of a therapeutic pillow.

Traditionally, such therapeutic pillows are not adjustable. The lack of adjustability hampers the ability to utilize the pillow for reeducation (or correction of the curvature) of the spine.

Therefore, a need exists for an adjustable pillow that can be used to correct curvatures in the spine. The pillow should not only be adjustable for various patients, but for accommodating changes in a single patient over time. Thus, the pillow should be able to account for large adjustments as well as small, incremental adjustments.

BRIEF SUMMARY OF THE INVENTION

An aspect of the present invention may be regarded is an adjustable pillow having an upper housing comprising a plurality of compartments, a plurality of support elements and a lower housing secured to the upper housing to keep the support elements inside the upper housing. The support elements are configured to be positioned within one of the compartments. Each compartment has a height that is adjustable by varying the number of support elements positioned within the compartment.

Preferably, the compartments include a neck support compartment, a head support compartment and a pair of side support compartments. The neck support compartment may be rounded. Rounding the neck support compartment is achieved by having a rounded support element as the uppermost support element in the neck support compartment. The side support compartments may be beveled. Beveling the side support compartments is achieved by having a beveled support element as the uppermost support element in the side support compartment.

The support elements may be made of a foam material. The support elements may be cushioned filled with a support material. The cushions may be filled with air or water.

Preferably, the lower housing is adjustably securable to the upper housing. Hook and loop fastener strips may be used for adjustably securing the lower housing to the upper housing.

Each support element has a height. The heights of the support elements may not all be the same.

The height of the neck support and the height of the head support are adjusted for a user lying on his back. The height of one of the side supports is adjusted for a user lying on his side.

BRIEF DESCRIPTION OF THE DRAWINGS

These as well as other features of the present invention will become more apparent upon reference to the drawings wherein.

DETAILED DESCRIPTION OF THE INVENTION

Figure 7A:
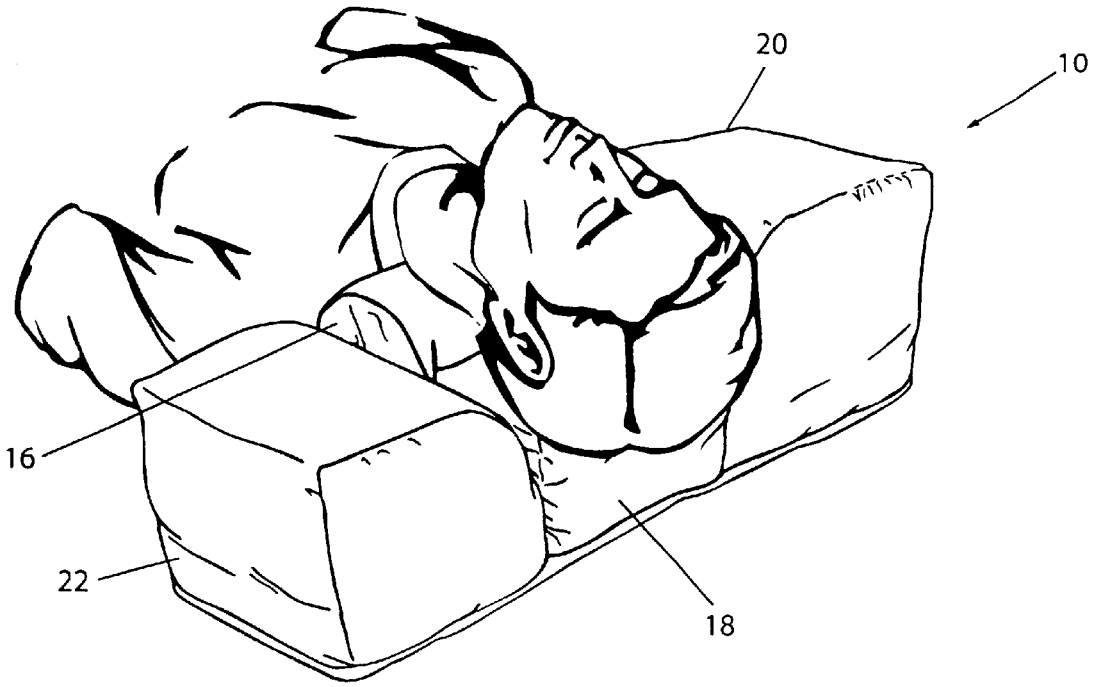
FIG. 7A illustrates the therapeutic sleep system in use with a patient sleeping on his back.
Figure 7B:
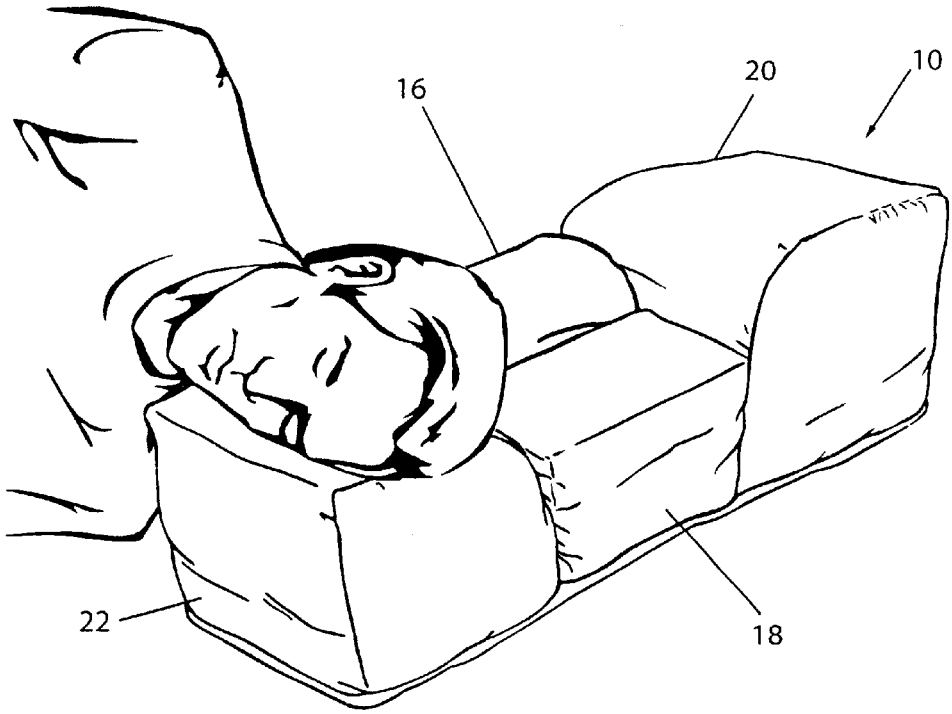
FIG. 7B illustrates the therapeutic sleep system in use with a patient sleeping on his side.

The preferred embodiment shown and described herein is ideally suited for treating the cervical spine of a patient. The therapeutic sleep system provides neuro musculo skeletal reeducation (i.e., adjustment) of the cervical spine. The therapeutic sleep system of the present invention not only provides support for the user's spine, neck and head, but it can be periodically adjusted so that the cervical spine is gradually adjusted to a proper curvature over time, i.e., physical therapy routine. As shown in FIGS. 7A and 7B, the therapeutic sleep system 10 provides support when the user is lying on his back (FIG. 7A) and when the user is lying on his side (FIG. 7B). While the preferred embodiment shown and described herein is used for the cervical spine, it will be appreciated that embodiments of the present invention can be used to provide adjustable support and/or reeducation for other areas of the user's body, for example, the lower back.

Figure 1:
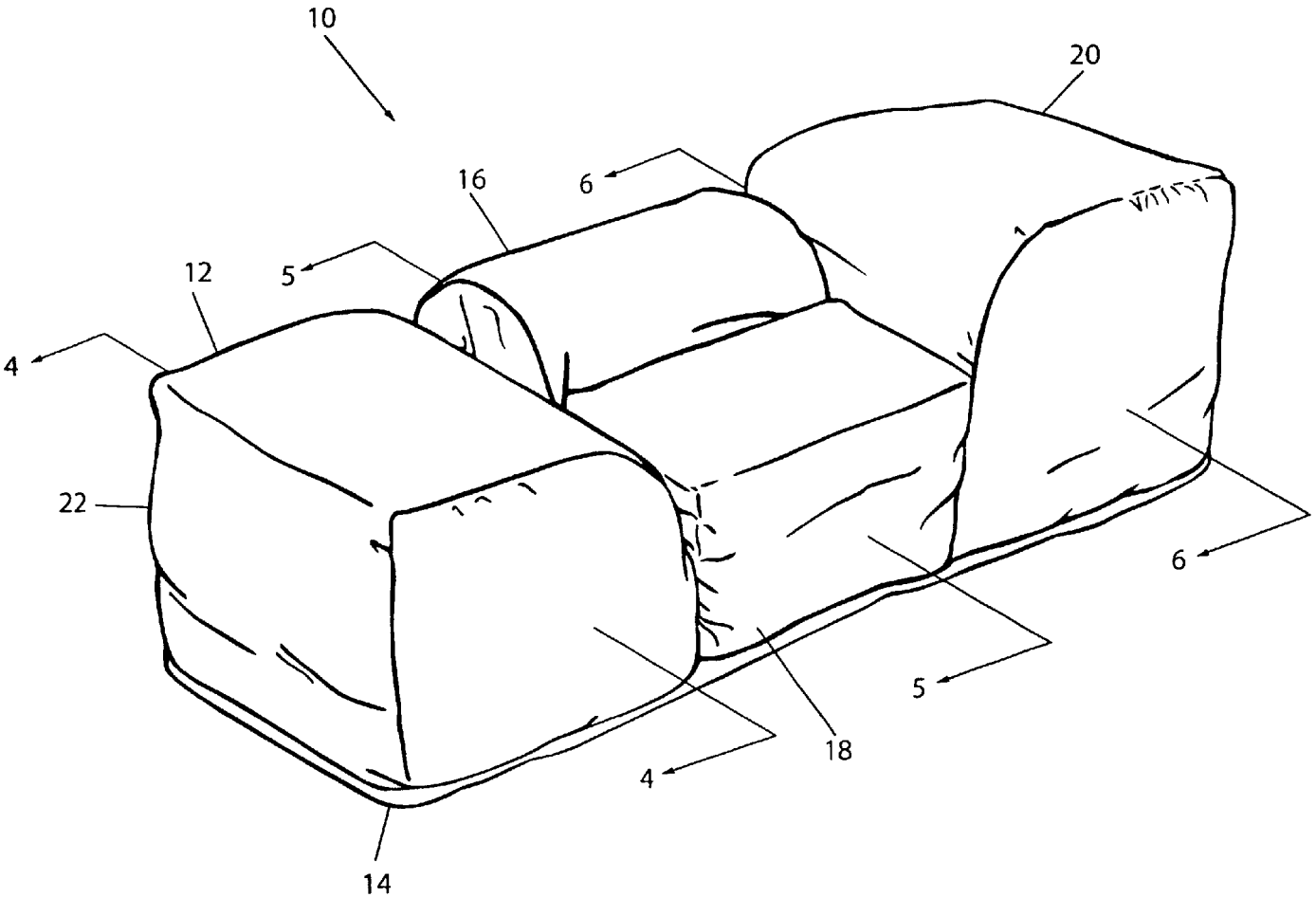
FIG. 1 is a perspective view of a therapeutic sleep system formed in accordance with the present invention.
Figure 2:
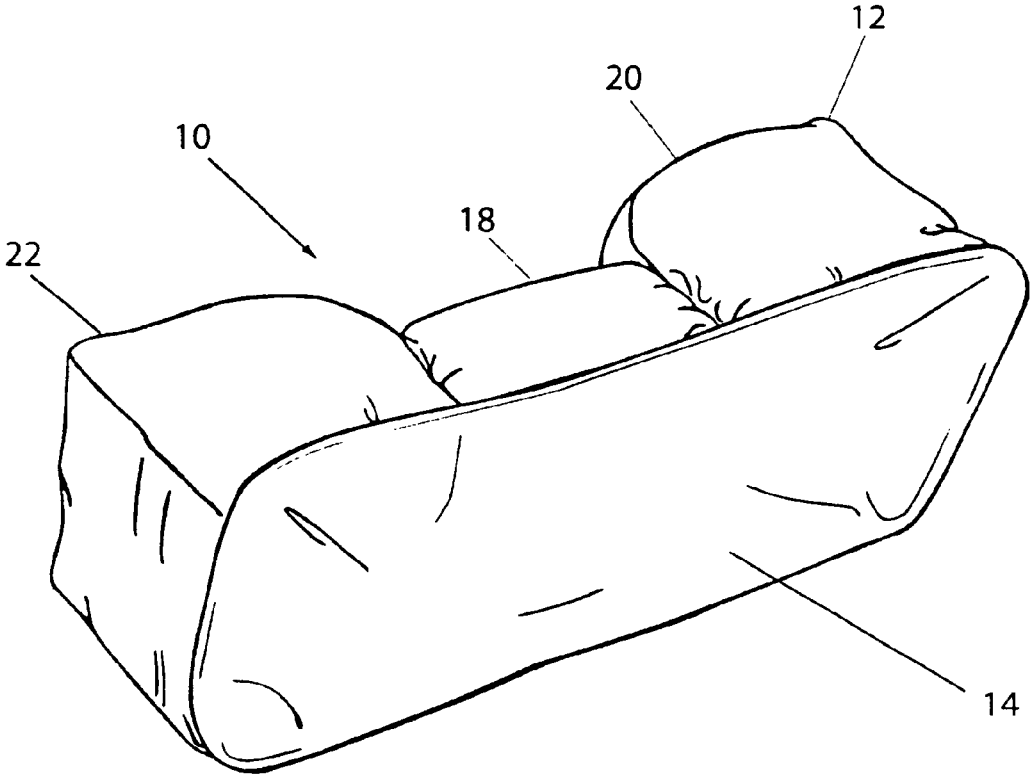
FIG. 2 is a bottom perspective view of the therapeutic sleep system shown in FIG. 1.

Referring now to the drawings wherein the showings are for purposes of illustrating preferred embodiments of the present invention only, and not for purposes of limiting the same, FIG. 1 is a perspective view of a therapeutic sleep system 10 formed in accordance with the present invention. The therapeutic sleep system 10 shown in FIG. 1. includes an upper housing 12 and a lower housing 14 (shown in FIG. 2). The upper housing 12 is divided into support compartments which include a neck support compartment 16, a head support compartment 18, a right side support compartment 20 and a left side support compartment 22. In exemplary embodiments, each of the compartments is created, e.g., by sewing together pieces of fabric. In exemplary embodiments, the upper housing 12 and lower housing 14 are made of a durable fabric such as a cotton or polyester material or a blend of cotton and polyester. The material may be a soft or brush material, such as velour. The lower housing 14 may be made from the same type of fabric or a different type of fabric than the upper housing 12. The compartments are then attached to each other (e.g., by sewing) to from a unitary upper housing 12 having multiple compartments.

As best shown in FIGS. 3A, 3B and 4–6, preferably, the height of each of the support compartments (neck support compartment 16, head support compartment 18, right side support compartment 20 and left side support compartment 22) is adjustable. A number of neck support elements 36, 46, 36A, 36B and 36C are placed in the neck support compartment 16. The height of the neck support compartment 16 varies depending on the number of neck support element 36, 46, 36A, 36B and 36C placed in the compartment. The other support compartments (head support compartment 18, right side support compartment 20 and left side support compartment 22) are adjustable as well. The height of the head support compartment 18 can be varied by varying the number of head support elements 38, 48, 38A and 38B placed in the head support compartment. The height of the right side support compartment 20 can be varied by varying the number of right side support elements 30, 40, 30A, 30B and 30C placed in the right side support compartment. The height of the left side support compartment 22 can be varied by varying the number of left side support elements 32, 42, 32A, 32B and 32C placed in the left side support compartment.

The heights of the compartments can be adjusted not just for different patients, but for a given patient over time. As a patient uses the therapeutic sleep system 10 of the present invention, his cervical spine slowly adjusts to a proper curvature. In order to obtain the ideal curvature, the height of one or more of the compartments may require adjusting after the patient has used the therapeutic sleep system 10 for a period of time. When the user is sleeping on his back as shown in FIG. 7A, the height of the neck support compartment 16 and/or the head support compartment 18 may be adjusted to suitable heights based on the curvature of the user's cervical spine. When the user is sleeping on his side as shown in FIG. 7B, the side support compartment 20, 22 may be adjusted to an appropriate height based on the distance between the user's neck and shoulders. Adjusting the height of various compartments of the therapeutic sleep system 10 allow the user's head to be elevated while keeping the user's spine in a desired alignment.

Figure 3A:
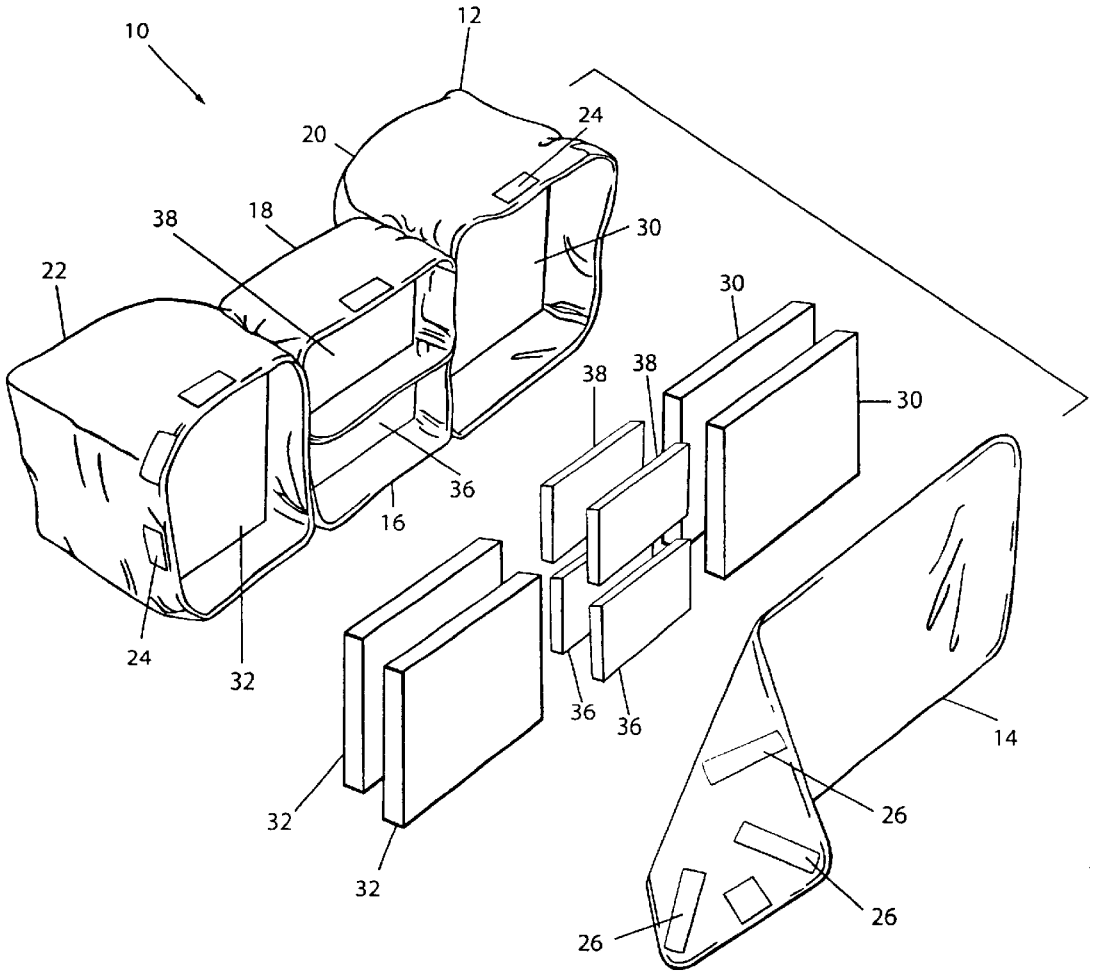
FIG. 3A is an exploded view of the therapeutic sleep system of FIG. 1 showing foam inserts used for adjusting the therapeutic sleep system.
Figure 3B:
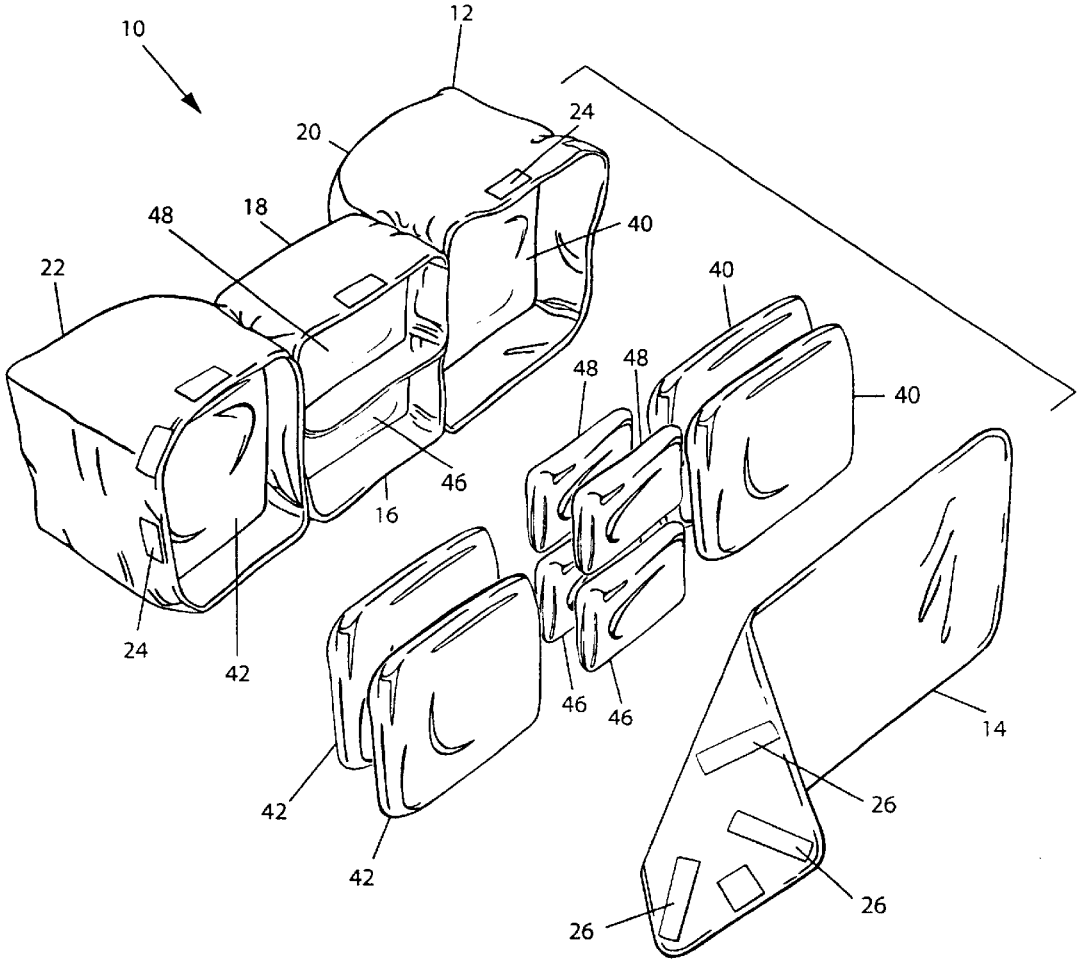
FIG. 3B is an exploded view of the therapeutic sleep system of FIG. 1 showing cushions (e.g., filled with water or air) used for adjusting the therapeutic sleep system.
Figure 4:
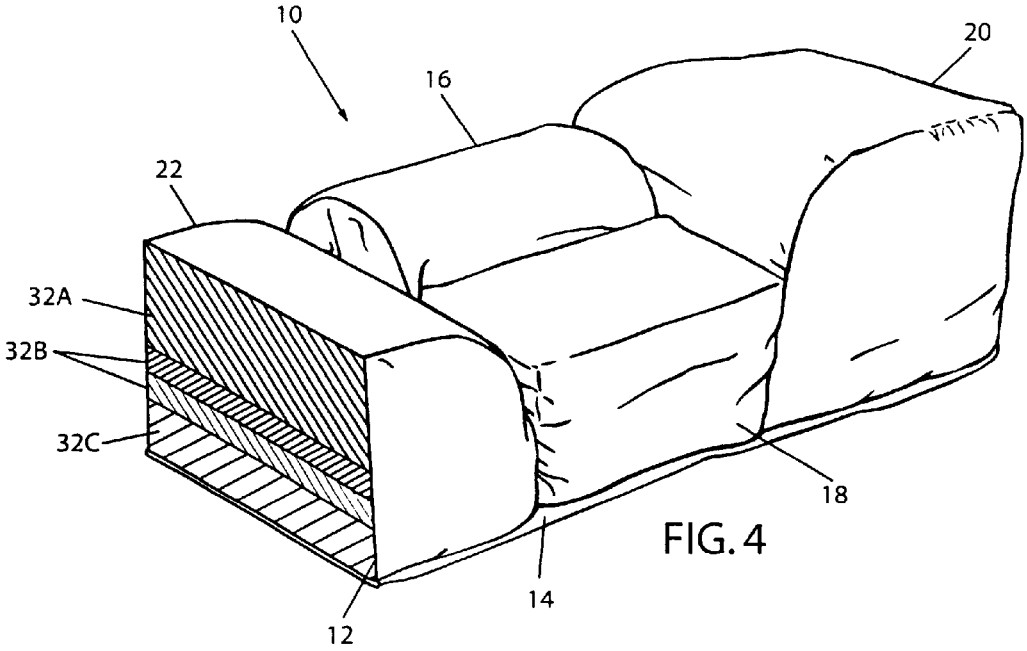
FIGS. 4, 5, and 6 illustrate cross sectional views of various regions of the therapeutic sleep section taken about cross section lines 4, 5, and 6 shown in FIG. 1.
Figure 5:
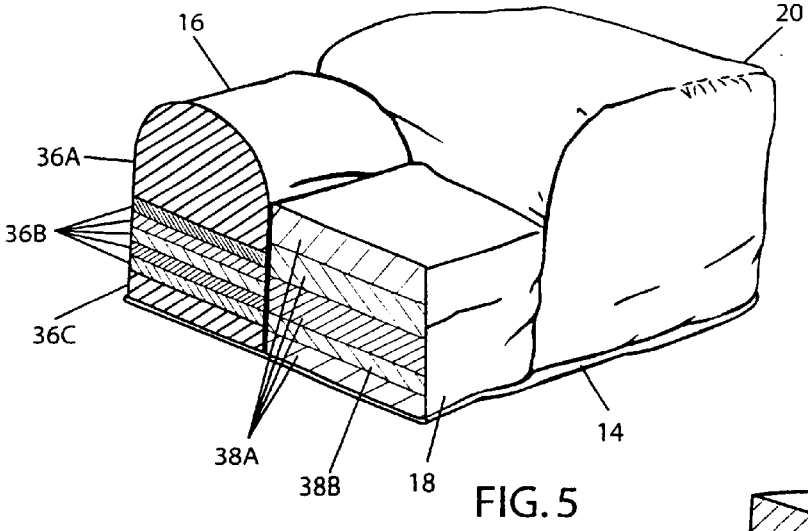
Figure 6:
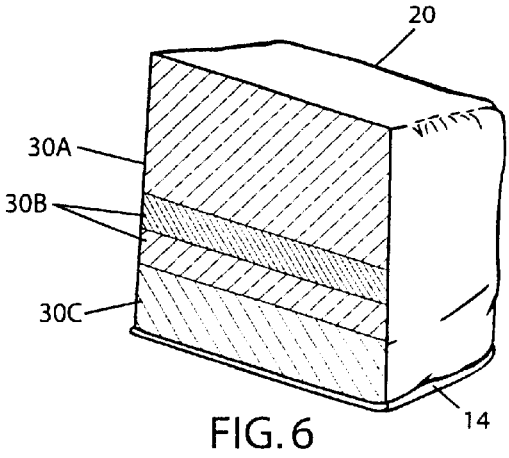

The embodiment shown in FIG. 3A includes support elements manufactured of a foam material. However, it will be appreciated that a variety of materials may be used for the support elements. For example, the support elements may be cushions that are filled with air or water. Some embodiments may use a combination of types of support elements. It will be appreciated that the support elements for a given compartment may vary in size (i.e., height). The support elements may also vary in density. For example, foam support elements having varying densities maybe used. Foams with a higher density may be used on the bottom while support elements made of a lower density foam are placed on the top to provide a softer sleeping surface for the user. The amount of air or water provided in support cushions can also be varied.

The lower housing 14 is attached to the upper housing 12 in order to keep the support elements in the compartmentalized upper housing 12. In exemplary embodiments, such as those shown, the lower housing 14 is a piece of fabric. The lower housing 14 is attachable to the upper housing 12. In the embodiments shown in FIGS. 3A and 3B, the upper housing 12 and lower housing 14 each include fasteners that can be fastened to each other. Preferably, the attachment means also allow for adjustability. For example, attachment means 24, 26 may be hook and loop fasteners, e.g., Velcro™ which allow the lower housing 14 to be adjustably secured to the upper housing 12. Thus, if there are less than the maximum amount of support elements positioned within the upper housing 12, the extra material of the upper housing is taken up by the lower housing to prevent the upper housing from becoming loose or baggy. It will be appreciated that constructing the lower housing 14 and/or the upper housing 12 from a stretchable fabric may be used in order to prevent the housing from becoming baggy when all of the maximum number of support elements are not positioned within the upper housing 12. In the exemplary embodiments shown in FIGS. 3A and 3B, the hook and loop fasteners 24, 26 are spaced along the edges of the upper and lower housings 12, 14. It will be appreciated that other configurations are possible. For example, hook-and loop fasteners 24, 26 could each be one continuous piece attached around the perimeters of the upper and lower housings, respectively.

In the exemplary embodiment shown in FIG. 3A, the overall size of the therapeutic support system is ten inches wide, twenty-four inches long and eight inches high. The neck support compartment 16 is five inches wide, eight inches long and six and ½ inches high if all of the support elements are used and includes one arched support element (uppermost neck support element) 36A that is five inches× eight inches×two inches, five support elements 36B that are each five inches×eight inches×½ inch and one support element 36C that is five inches×eight inches×one inch. The head support compartment 18 is five inches wide, eight inches long and five inches high if all of the support elements are used and includes four support elements 38A that are each five inches×eight inches×one inch and one support element 38B that is five inches×eight inches×½ inch. Each side support compartment 20, 22 is ten inches wide, eight inches long and eight inches high if all of the support elements are used and includes one beveled support element (uppermost side support element) 30A or 32A that is ten inches×eight inches×four inches, two support elements 30B or 32B that are ten inches×eight inches×one inch and one support element 30C or 32C that is ten inches×eight inches×two inches. It will be appreciated that other combinations of sizes of support elements can be used.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. An adjustable pillow, comprising:

an upper housing comprising a plurality of compartments;

a plurality of support elements, each support element configured to be positioned within one of the compartments, each compartment having a height that is adjustable by varying a number of support elements positioned within the compartment; and a lower housing secured to the upper housing to keep the support elements inside the upper housing, wherein the compartments comprise a neck support compartment, a head support compartment and a pair of side support compartments.

2. The adjustable pillow of claim 1, wherein one of the support elements in the neck support compartment is rounded, the rounded support element being the uppermost support element in the neck support compartment.

3. The adjustable pillow of claim 1, wherein one of the support elements in each of the side support compartments is beveled, the beveled support elements being the uppermost elements in the respective side support compartments.

4. The adjustable pillow of claim 1, wherein the support elements are made of a foam material.

5. The adjustable pillow of claim 1, wherein the support elements are cushions that are filled with a support material.

6. The adjustable pillow of claim 5, wherein the cushions are filled with air.

7. The adjustable pillow of claim 5, wherein the cushions are filled with water.

8. The adjustable pillow of claim 1, wherein the lower housing is adjustably securable to the upper housing.

9. The adjustable pillow of claim 8, wherein the lower housing comprises a plurality of hook and loop fastener strips for adjustably securing the lower housing to the upper housing.

10. An adjustable pillow, comprising:

an upper housing comprising a plurality of compartments;

a plurality of support elements, each support element configured to be positioned within one of the compartments, each compartment having a height that is adjustable by varying a number of support elements positioned within the compartment; and a lower housing secured to the upper housing to keep the support elements inside the upper housing, wherein each support element has a height and wherein the heights of the support elements are not all the same.

11. A therapeutic sleep system, comprising:

an upper housing comprising:

a hollow neck support compartment and a hollow head support compartment located adjacent thereto to form a center support compartment, the center support compartment having a pair of short sides with one short side formed by a side of the neck support compartment and an opposite short side formed by a side of the head support compartment and a pair of long sides with each of the long sides being formed by a side of the head support and a side of the neck support; and two hollow side support compartments, one side support compartment located adjacent to one of the long sides and the other side support compartment located adjacent to the opposite long side;

a plurality of support elements comprising:

a plurality of neck support elements configured to be positioned within the neck support compartment to form a neck support, the neck support having a height that is adjustable by varying a number of neck support elements positioned within the neck support compartment;

a plurality of head support elements configured to be positioned within the head support compartment, the head support having a height that is adjustable by varying a number of head support elements positioned within the head support compartment;

a plurality of side support elements configured to be positioned within the two side support compartments to create two side supports, each of the side supports having a height that is adjustable by varying a number of side support elements positioned within the side support compartment; and a lower housing secured to the upper housing to keep the neck support elements, the head support elements and the side support elements inside the upper housing.

12. The therapeutic sleep system of claim 11, wherein the support elements are made of a foam material.

13. The therapeutic sleep system of claim 11, wherein the support elements are cushions filled with a support material.

14. The therapeutic sleep system of claim 13, wherein the cushions are filled with air.

15. The therapeutic sleep system of claim 13, wherein the cushions are filled with water.

16. The therapeutic sleep system of claim 11, wherein the lower housing is adjustably securable to the upper housing.

17. The therapeutic sleep system of claim 16, wherein the lower housing comprises a plurality of hook and loop fastener strips for adjustably securing the lower housing to the upper housing.

18. The therapeutic sleep system of claim 11, wherein each support element has a height and wherein the heights of the support elements are not all the same.

19. The therapeutic sleep system of claim 11, wherein one of the support elements in the neck support compartment is rounded, the rounded element being the uppermost element in the neck support compartment.

20. The therapeutic sleep system of claim 11, wherein one of the support elements in each of the side support compartments is beveled, the beveled support elements being the uppermost elements in the respective side support compartments.

21. The therapeutic sleep system of claim 11, wherein the height of the neck support and the height of the head support are adjusted for a user lying on his back.

22. The therapeutic sleep system of claim 11, wherein the height of one of the side supports is adjusted for a user lying on his side.

* * * * *